US009506728B2

(12) United States Patent
Bosscher et al.

(10) Patent No.: US 9,506,728 B2
(45) Date of Patent: Nov. 29, 2016

(54) RECOIL ABSORBING MECHANISM

(71) Applicant: HARRIS CORPORATION, Melbourne, FL (US)

(72) Inventors: Paul M. Bosscher, West Melbourne, FL (US); Matthew D. Summer, Melbourne, FL (US); Michael E. Bowman, Melbourne, FL (US); Loran J. Wilkinson, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 361 days.

(21) Appl. No.: 14/450,869

(22) Filed: Aug. 4, 2014

(65) Prior Publication Data

US 2016/0033239 A1 Feb. 4, 2016

(51) Int. Cl.

| | |
|---|---|
| ***F41A 25/00*** | (2006.01) |
| ***F41H 11/12*** | (2011.01) |
| ***F41A 25/10*** | (2006.01) |
| ***F41A 25/12*** | (2006.01) |
| ***F41B 9/00*** | (2006.01) |

(52) U.S. Cl.

CPC ..... *F41H 11/12* (2013.01); *F41A 25/10* (2013.01); *F41A 25/12* (2013.01); *F41B 9/0046* (2013.01)

(58) Field of Classification Search

CPC ..... F41H 11/12; F41A 25/10; F41A 25/12; F41B 9/0046

USPC ..... 89/42.01–44.01, 1.13

See application file for complete search history.

(56) References Cited

U.S. PATENT DOCUMENTS 789,806 A * 5/1905 Haussner ..... F41A 25/10 89/44.01
2,790,357 A * 4/1957 Emil ..... F41A 25/18 89/37.05
3,004,475 A * 10/1961 Barr ..... F41A 9/07 89/1.801
3,604,308 A * 9/1971 Schulz ..... F41A 25/26 89/42.03
3,672,255 A * 6/1972 Findlay ..... F41A 25/12 89/1.7
3,783,738 A * 1/1974 Pelat ..... F41A 25/16 188/136
3,805,608 A * 4/1974 Schmidt ..... F41A 23/16 73/11.04

(Continued)

FOREIGN PATENT DOCUMENTS

EP 2 400 255 A2 12/2011
EP 2 406 519 A1 1/2012

OTHER PUBLICATIONS

Extended European Search Report dated Dec. 15, 2015 for EP Application No. 15001697.0-1655.

*Primary Examiner* — Michelle R Clement
(74) *Attorney, Agent, or Firm* — Fox Rothschild LLP; Robert J. Sacco; Carol E. Thorstad-Forsyth

(57) ABSTRACT

Systems (100) and methods (1200) for recoil absorption. The methods comprising: causing a moving carrier (102) to freely travel linearly in a first direction by discharging at least one recoil producing device (110-114); absorbing an impulse force resulting from discharging the recoil producing device using a spring (122, 124) having a first end coupled to the moving carrier and a second end (130) coupled to a fixed frame member (132); and applying a pulling force by the spring to the moving carrier in a second direction opposed from the first direction at an end of spring travel, whereby a uni-directional force transfer mechanism (610) is caused to engage an elongate latching element so as to latch the moving carrier in position and prevent the moving carrier from freely traveling in the second direction.

20 Claims, 9 Drawing Sheets

(56) References Cited

U.S. PATENT DOCUMENTS 4,088,057 A 5/1978 Nasypany
4,261,247 A * 4/1981 Reynolds ..... F41A 7/02 185/37
4,391,180 A * 7/1983 Koine ..... F41A 25/16 89/129.01
4,476,969 A * 10/1984 Dykema ..... F41A 25/10 188/380
5,014,595 A * 5/1991 Ducolon, Jr. ..... F41A 25/10 89/178
5,105,715 A * 4/1992 Nordmann ..... F41A 25/00 89/36.13
5,811,720 A * 9/1998 Quinnell ..... F41A 23/16 42/94
6,408,731 B1 * 6/2002 Elsener ..... F41A 1/10 102/440
6,578,464 B2 * 6/2003 Ebersole, Jr. ..... F41A 25/06 42/1.06
6,789,456 B2 * 9/2004 DeRoos ..... F41A 25/06 188/136
6,802,406 B2 * 10/2004 Martin ..... F41A 25/02 188/274
6,889,594 B2 * 5/2005 Ebersole, Jr. ..... F41A 25/06 42/1.06
7,228,778 B2 6/2007 Edwards et al.
7,481,146 B2 * 1/2009 Weiss ..... F41A 19/58 102/293
7,878,105 B2 * 2/2011 More ..... F41A 25/04 89/43.01
7,997,179 B1 * 8/2011 Nelson ..... F41A 11/02 181/110
8,082,836 B2 * 12/2011 More ..... F41A 25/04 89/43.01
8,276,501 B1 10/2012 Sukurlu
8,281,703 B2 * 10/2012 Moore ..... F41A 25/04 89/43.01
8,297,172 B2 * 10/2012 Nelson ..... F41A 19/08 89/27.3
8,297,174 B1 * 10/2012 Russell ..... F41A 25/12 89/37.14
8,707,846 B2 4/2014 Kohnen
8,800,735 B2 * 8/2014 Ruthinowski ..... F16F 7/09 188/372
8,899,141 B2 * 12/2014 Reynolds ..... F41A 5/12 89/129.01
9,021,728 B1 * 5/2015 Kocmich, IV ..... F41A 23/04 248/562
9,134,086 B2 * 9/2015 Lim ..... F41A 25/02
9,435,602 B1 * 9/2016 Tomik ..... F41A 25/10
2003/0041724 A1 * 3/2003 Ebersole, Jr. ..... F41A 25/06 89/42.01
2003/0200862 A1 * 10/2003 Ebersole, Jr. ..... F41A 25/06 89/42.01
2006/0011056 A1 * 1/2006 Edwards ..... F41A 25/02 89/14.3
2008/0178508 A1 * 7/2008 Cinciu ..... F41C 23/06 42/1.06
2010/0109217 A1 * 5/2010 Ruthinowski ..... F16F 7/09 267/140.13
2011/0000363 A1 * 1/2011 More ..... F41A 25/04 89/43.01
2011/0083550 A1 * 4/2011 More ..... F41A 25/04 89/43.01
2011/0266105 A1 * 11/2011 Yamamoto ..... F16F 9/3485 188/280
2012/0001460 A1 * 1/2012 Ruthinowski ..... B60N 2/2809 297/216.11
2012/0210864 A1 * 8/2012 More ..... F41A 25/04 89/43.01
2013/0033056 A1 * 2/2013 Tunis, III ..... B60N 2/24 296/19
2014/0230642 A1 * 8/2014 Reynolds ..... F41A 5/12 89/130
2014/0291452 A1 * 10/2014 Martinez ..... B64G 1/66 244/173.2
2016/0102945 A1 * 4/2016 Itzkowitz ..... F41G 5/16 89/37.14

* cited by examiner

RECOIL ABSORBING MECHANISM

BACKGROUND

Statement of the Technical Field

The inventive arrangements relate to recoil absorbing mechanism. More particularly, the inventive arrangements concern recoil absorbing mechanisms useful with Recoil Producing Devices ("RPDs"), such as energetic disruptors.

Description of the Related Art

There are various robotic platforms known in the art that comprise energetic disruptors (e.g., water jet disruptors) for inspecting and rendering threatening items (e.g., bombs) safe. Such robotic platforms are employed in various applications. Conventionally, robotic platforms have been used by police, bomb squads, and military personnel. Use of conventional energetic disruptors is difficult.

In some cases, the deployment platform comprises a tripod-like assembly which needs to be manually placed near a suspicious item, whereby the operator is placed in harm's way. The tripod-like assembly has a limited set of firing locations and elevations.

In other cases, the robotic platform comprises a movable arm to which the energetic disruptor is fixedly attached at a given location thereon. The movable arm does allow the energetic disruptor to be easily repositioned and aimed. However, the movable arm is over designed for all other applications of use thereof because it has to be strong enough to withstand the brief, high impulse load applied thereto when the energetic disruptor is shot. In effect, the robot is undesirably heavy and bulky. Also, the disruptor is attached to the movable arm so as to have a fixed position adjacent to a distal end thereof. In effect, the disruptor may interfere with other operations in which the movable arm is being employed. Additionally, the energetic disruptor applies a relatively high impulse load to the movable arm when shot. The high impulse load may cause damage to the movable arm.

In yet other cases, the disruptor is mounted to a robotic arm with a recoil absorber. The recoil absorber does decrease the impulse load on the robot. However, the conventional recoil absorber designs are long and bulky. The amount of stroke in the conventional recoil absorber designs is relatively small in comparison to the overall bulk of the device. A lot of times, the robotic arm comprises a gripper at a distal end thereof. The disruptor may interfere with gripper operations and/or damage the gripper when shot.

One conventional recoil absorber comprises a coil spring and damper. The damper is necessary to even out the shock load and dissipate energy. The issue with the spring/damper design is that: the damper adds an undesirable amount of weight and bulk to the design; and the design has a poor length ratio between the stroke length of the recoil absorber and the total length of the recoil absorber.

SUMMARY OF THE INVENTION

The invention concerns implementing systems and methods for recoil absorption. The methods comprise causing a moving carrier to freely travel linearly in a first direction by discharging at least one RPD (e.g., a disruptor). An impulse force resulting from the RPD's discharge is absorbed using at least one spring (e.g., a constant force spring or a coil spring). The spring has a first end coupled to the moving carrier and a second end coupled to a fixed frame member. A pulling force is applied by the spring to the moving carrier in a second direction opposed from the first direction at an end of spring travel. Consequently, a uni-directional force transfer mechanism is caused to engage an elongate latching element (e.g., a threaded or notched rod) so as to latch the moving carrier in position and prevent the moving carrier from freely traveling in the second direction.

The moving carrier can then be caused to travel linearly in the second direction by rotating the elongate latching element or pushing the elongate latching element in the second direction. Such rotation or pushing causes the uni-directional force transfer mechanism to be displaced along a length of the latching element.

In some scenarios, the uni-directional force transfer mechanism comprises a split nut attached to a rigid support structure via mechanical spring elements. Additionally or alternatively, the uni-directional force transfer mechanism comprises a plurality of flexible fins engaging threads or notches formed along a length of the elongate latching element. A sensor may be provided to sense a position of the moving carrier along a length of the elongate latching element.

BRIEF DESCRIPTION OF THE DRAWINGS

Embodiments will be described with reference to the following drawing figures, in which like numerals represent like items throughout the figures, and in which.

DETAILED DESCRIPTION

Figure 1:
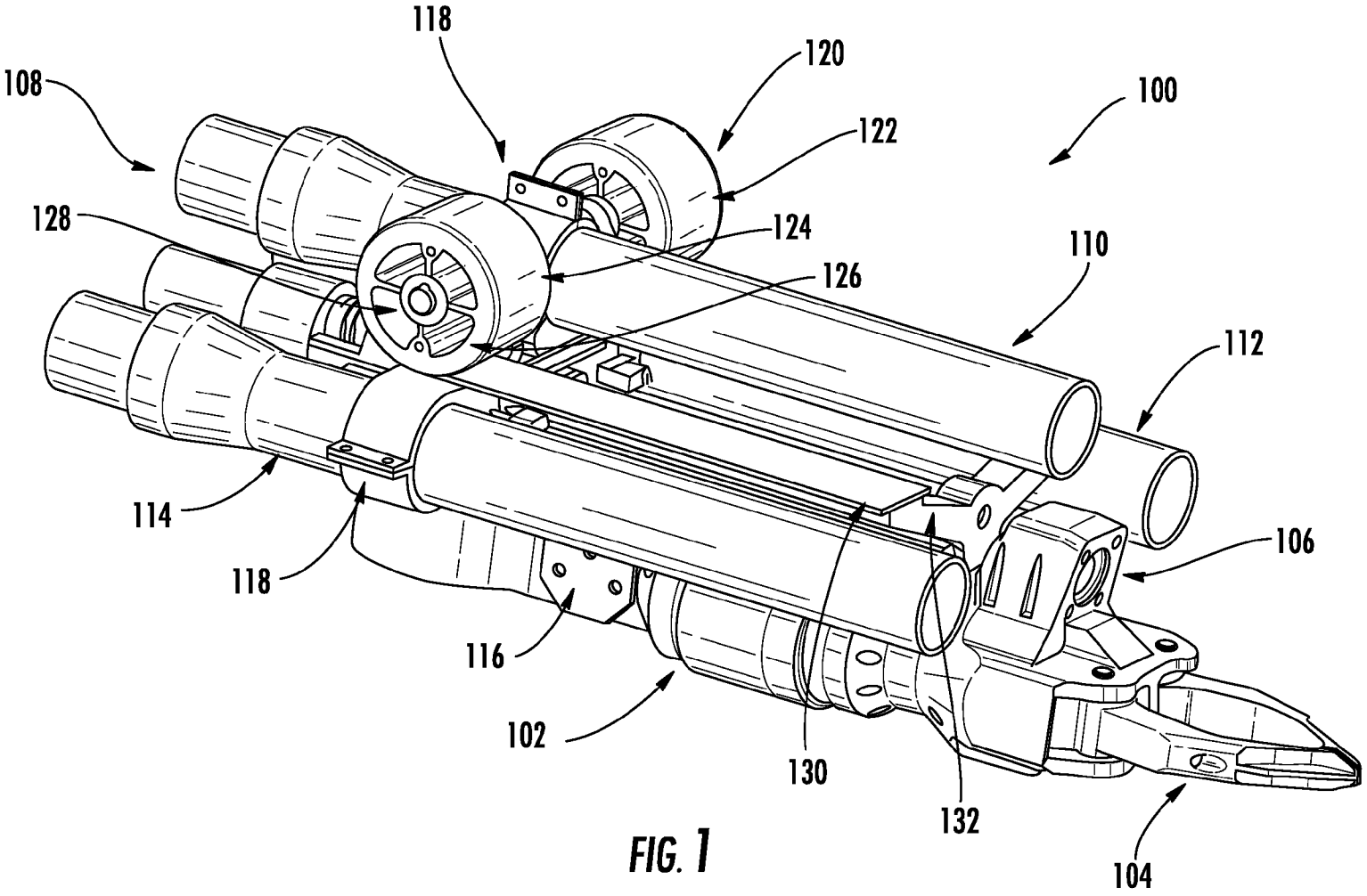
FIG. 1 is a front perspective view of a robotic assembly with an RPD assembly in a retracted state.
Figure 2:
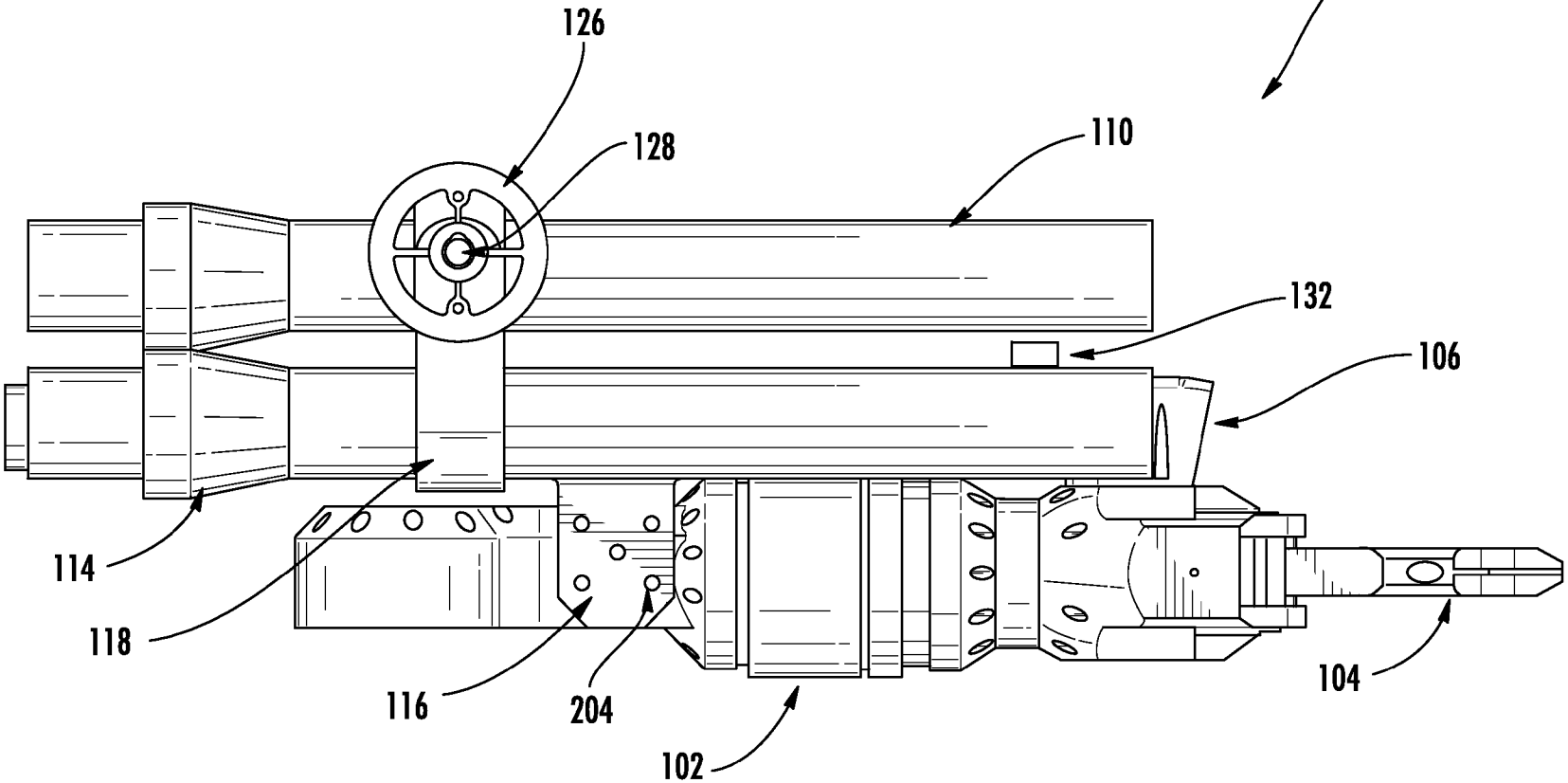
FIG. 2 is a side view of the robotic assembly shown in FIG. 1.
Figure 3:
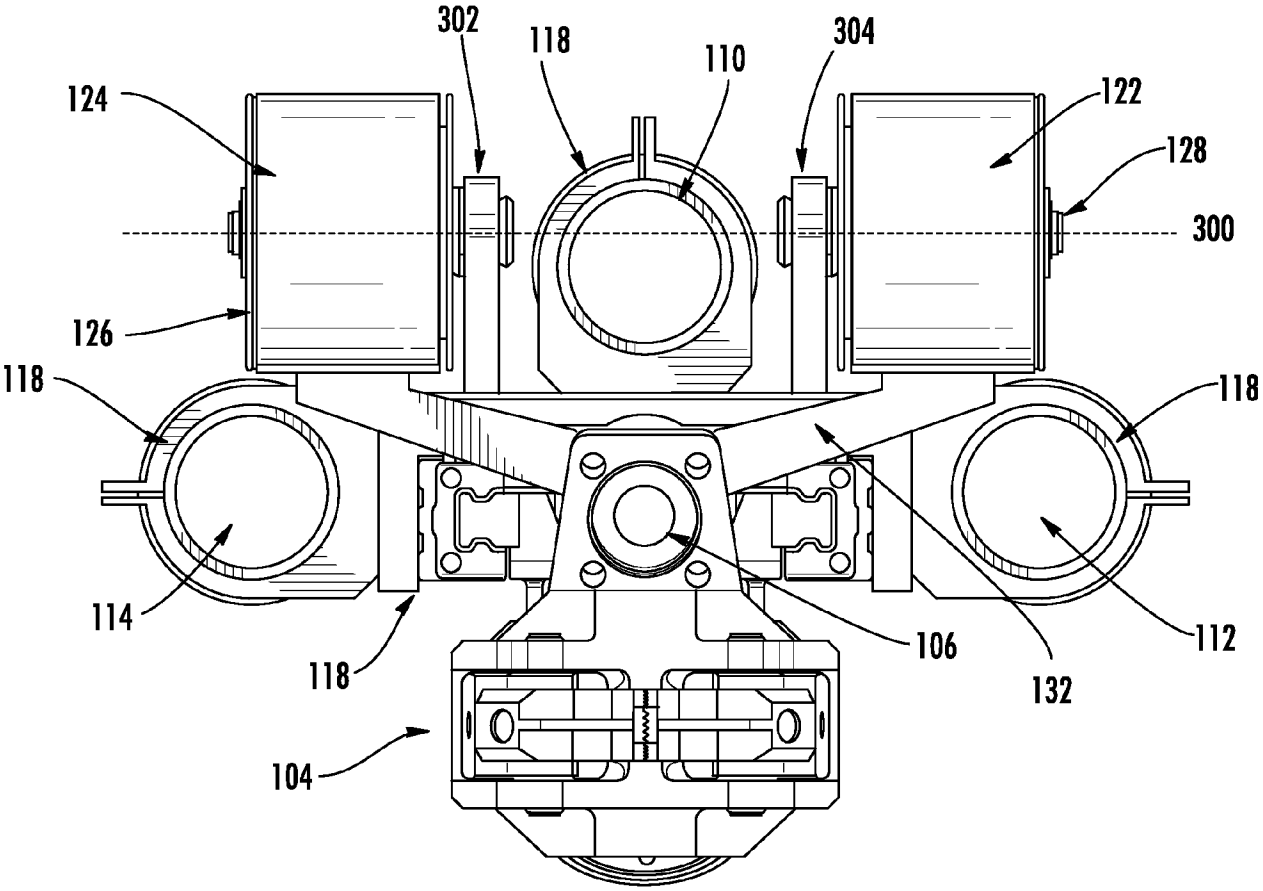
FIG. 3 is front view of the robotic assembly shown in FIGS. 1-2.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present invention concerns systems and methods for recoil absorption. The systems comprise a RPD coupled to a moving carrier. The term "RPD", as used herein, reference to any device that produces recoil. An example of such a device is a disruptor or a weapon from which something is propelled (e.g., water, bullets, shells, missiles, etc.). As a result of discharging the RPD device (e.g., a disruptor), a moving carrier is caused to freely travel linearly in a first direction. An impulse force resulting from the RPD's discharge is absorbed using at least one spring (e.g., a constant force spring or a coil spring). The spring has a first end coupled to the moving carrier and a second end coupled to a fixed frame member. A pulling force is applied by the spring to the moving carrier in a second direction opposed from the first direction at an end of spring travel. Consequently, a uni-directional force transfer mechanism is caused to engage an elongate latching element (e.g., a threaded or notched rod) so as to latch the moving carrier in position and prevent the moving carrier from freely traveling in the second direction. The moving carrier can then be caused to travel linearly in the second direction by rotating the elongate latching element or pushing the elongate latching element in the second direction. Such rotation or pushing causes the uni-directional force transfer mechanism to be displaced along a length of the latching element.

Referring now to FIGS. 1-5, an exemplary architecture for a robotic assembly 100 will now be discussed. Only a robotic arm portion of the robotic assembly 100 is shown in FIGS. 1-5. The robotic arm 102 can be coupled to a vehicle base. Vehicle bases are well known in the art, and therefore will not be described herein. Any known or to be known vehicle base can be used herein without limitation.

The robotic assembly 100 is configured to act as a robotic gripping mechanism for remote investigation of items and an explosive disruption mechanism for remotely disarming explosive devices (e.g., pipe bombs, letter bombs, hand grenades, land mines, etc.). The robotic gripping mechanism comprises a gripper 104 coupled to a distal end of the robotic arm 102. Grippers are well known in the art, and therefore will not be described herein. Any known or to be known gripper can be used herein without limitation.

The explosive disruption mechanism comprises an Explosive Disruption Assembly ("EDA") 108 coupled to the robotic arm 102. The EDA 108 is coupled to the robotic arm via mounting structures 202. The mounting structures 202 may each comprise a plate 116 with apertures 204 formed therein. The apertures 204 are sized and shaped such that couplers (e.g., screws) can pass therethrough. The couplers secure the plate 116 to the robotic arm 102.

The EDA 108 is shown as comprising three RPDs 110-114. The present invention is not limited in this regard. Any number of RPDs, physical size(s) of RPDs, and/or energy sizes of RPDs can be employed herein without limitation. Also, any type of RPD and/or combination of various types of RPDs can be employed herein without limitation. For example, a first RPD may comprise a metal tube from which water is propelled, while a second RPD comprises a metal tube from which bullets are propelled.

Figure 4:
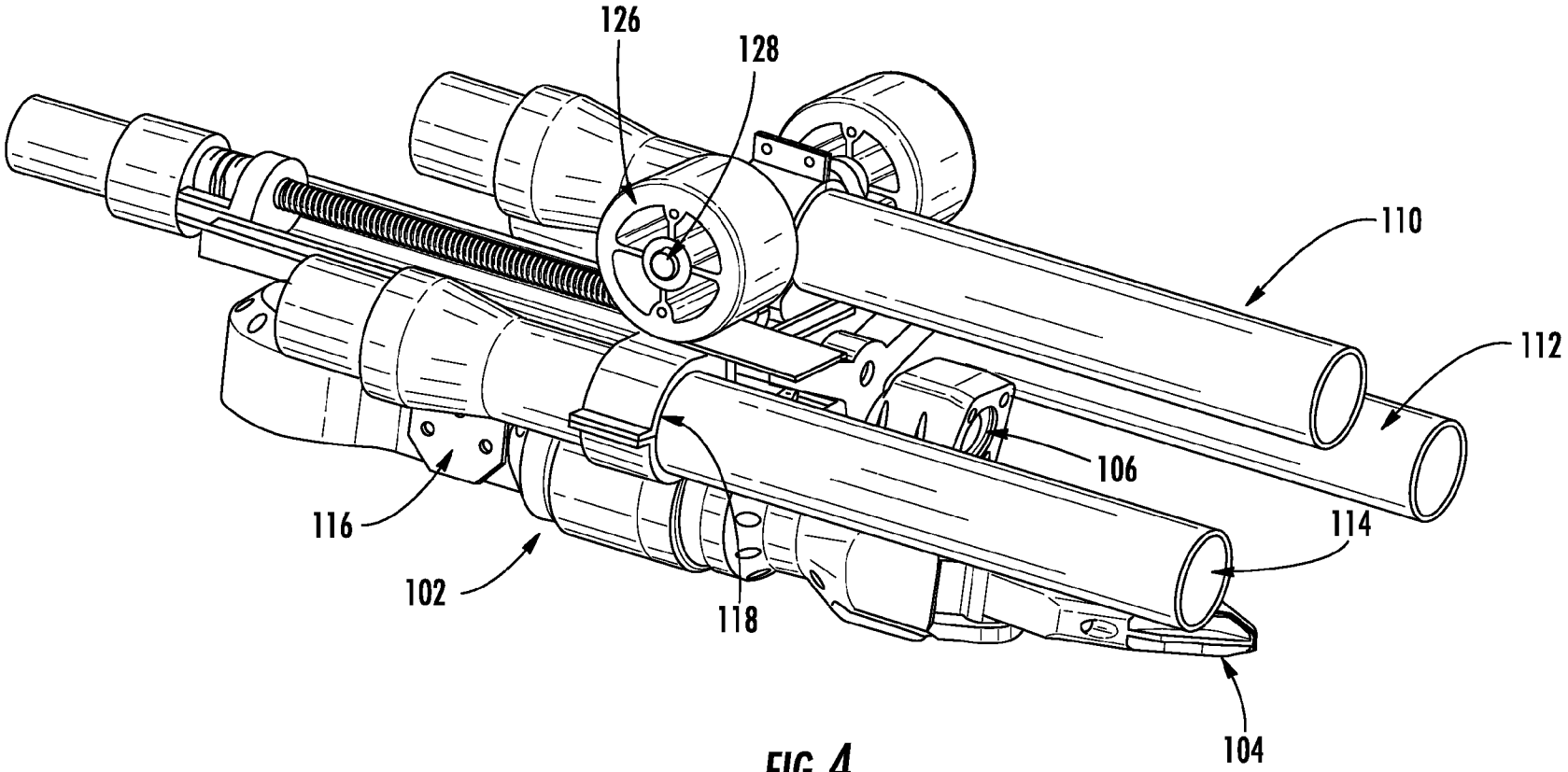
FIG. 4 is a front perspective view of the robotic assembly shown in FIGS. 1-3 with the RPD in a deployed state.

The EDA 108 also comprises a moving carrier 118 for the RPDs 110-114. The moving carrier 118 is configured to facilitate the deployment of the RPDs 110-114 (as shown in FIG. 4) and the retraction of the RPDs 110-114 (as shown in FIGS. 1-3 and 5). The transition between the deployed/retraction positions of the RPDs 110-114 is achieved by causing the moving carrier 118 to travel linearly in directions 502, 504 along the length of the robotic arm 102. One way in which such linear movement of the moving carrier 118 is achieved will be discussed below in relation to FIGS. 6-8.

The EDA 108 further comprises a Recoil Absorption Mechanism ("RAM") 120 for the RPDs 110-114. The RAM 120 includes at least one spring 122, 124. The springs 122, 124 are shown as comprising constant force springs. Constant force springs are well known in the art, and therefore will not be described in detail herein. Still, it should be understood that the force exerted by each spring 122, 124 over its range of motion is a constant. Thus, unlike conventional recoil absorption mechanisms, the RAM 120 does not need to be tuned to handle a particular type of impulse created from weapons firing since the force transmitted to the robotic arm is constant. This feature of the RAM 120 facilitates the use of varying sizes/energy RPDs as described above.

The spring 122, 124 is formed as a rolled ribbon of spring material (e.g., spring steel) such that it is relaxed when it is fully rolled up. As the spring 122, 124 is unrolled, the restoring force comes primarily from the portion of the ribbon near the roll. Because the geometry of that region remains nearly constant as the spring unrolls, the resulting force is nearly constant. The constant resulting force is an important feature of the springs 122, 124, which will become evident as the discussion progresses.

Figure 8:
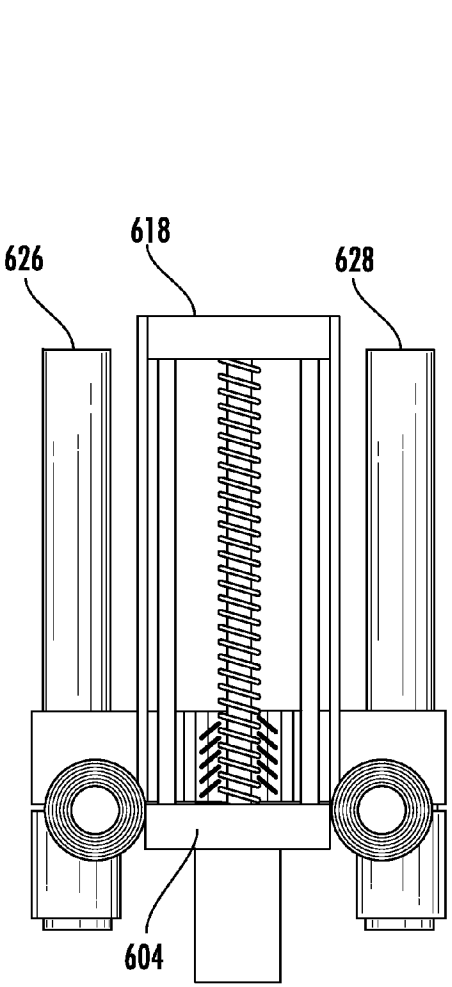
FIGS. 6-8 provide schematic illustrations that are useful for understanding retraction and deployment operations of the RPD assembly shown in FIGS. 1-5.
Figure 7:
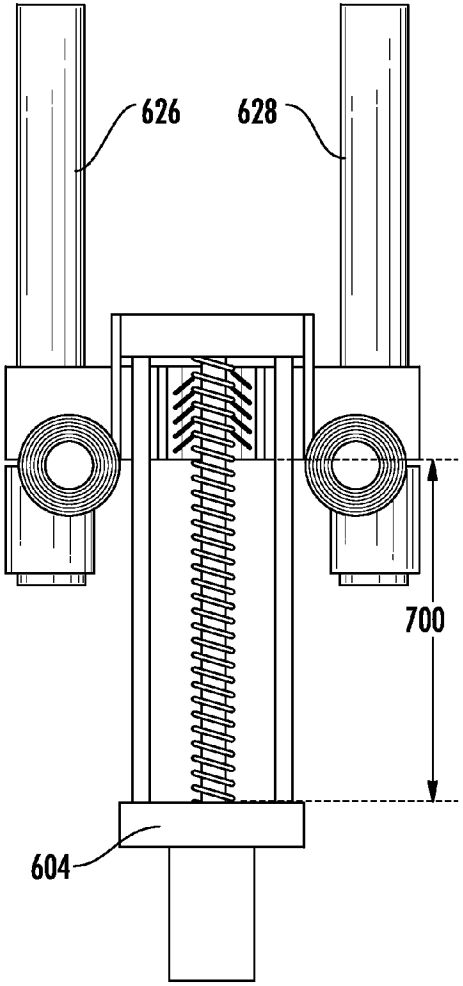

The springs 122, 124 can be arranged in various configurations relative to the RPDs 110-114. For example, as shown in FIGS. 1-5, the springs 122, 124 are arranged such that a central axis 300 thereof is parallel to a horizontal plane defined by the RPDs 112, 114. The springs can alternatively be arranged to have a central axis that is perpendicular to the horizontal plane defined by the RPD, as shown in FIGS. 6-8.

The particular arrangement of the springs 122, 124 is maintained by: coupling a first end (not visible in the figures) thereof to a reel 126; and coupling the reel 126 to the moving carrier 118. In this regard, the moving carrier 118 comprises upward extending flanges 302, 304 with apertures (not visible in the figures) formed therein. A rod 128 is disposed through the reel 126 and the aperture of the respective flange such that the reel 126 is rotatably coupled to the moving carrier 118. The rotatable coupling of the reel 126 to the moving carrier 118 allows the springs 122, 124 to be transitioned between their rolled positions shown in FIG. 4 and their unrolled positions shown in FIG. 1. Notably, a second end 130 of each spring 122, 124 is attached to a stationary frame member 132 so as to enable the unrolling of the spring upon discharge of an RPD.

The present invention is not limited to constant force springs. Additionally or alternatively, the springs may comprise coil springs or helical springs for storing energy due to resilience and subsequently release the stored energy to absorb an impulse force caused by firing the RPDs 110-114. Coil springs are made of an elastic material which returns to its material length when unloaded. The force that is applied to a coil spring is proportional to the displacement of the coil spring. As such, the coil springs can decelerate the RPDs 110-114 and the moving carrier from some initial high velocity immediately after weapon firing down to zero at the end of spring travel. The force transmitted to the robotic arm from the coil springs increases as the displacement of the coil spring increases. As such, the force is not a constant force as is the case with the constant force springs. Thus, for a given amount of energy that needs to be absorbed from weapon firing, the constant force spring provides the lowest peak force transmitted to the robotic arm as compared to that of the coil spring. Also, the overall collapsed size of the coil spring is larger than that of the constant force spring. The coil spring may be deformed as a result of overloading thereof. Such deformation does not occur with the constant force springs.

Figure 5:
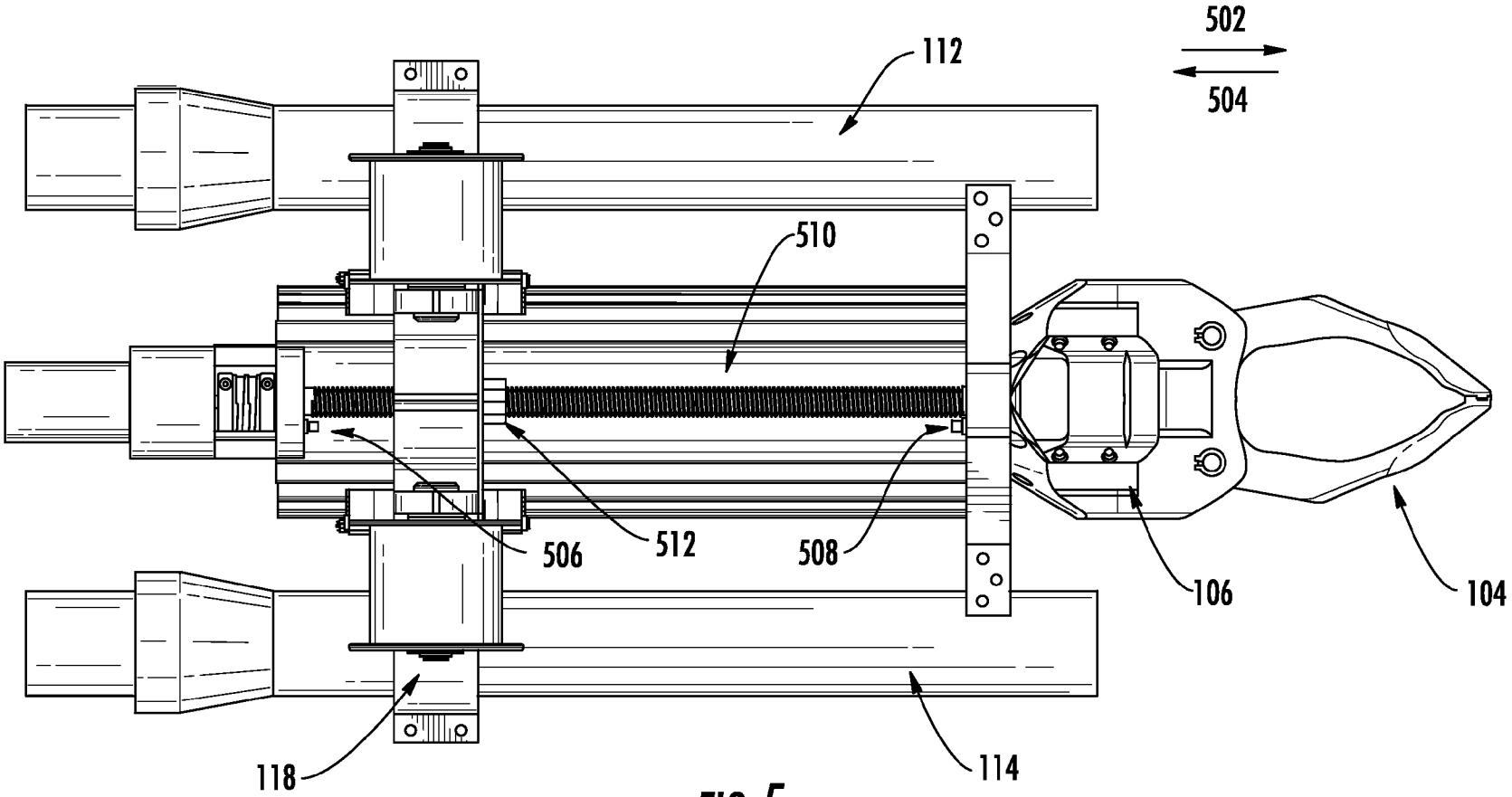
FIG. 5 is a top view of the robotic assembly shown in FIGS. 1-4 with an RPD of the RPD assembly removed therefrom.
Figure 6:
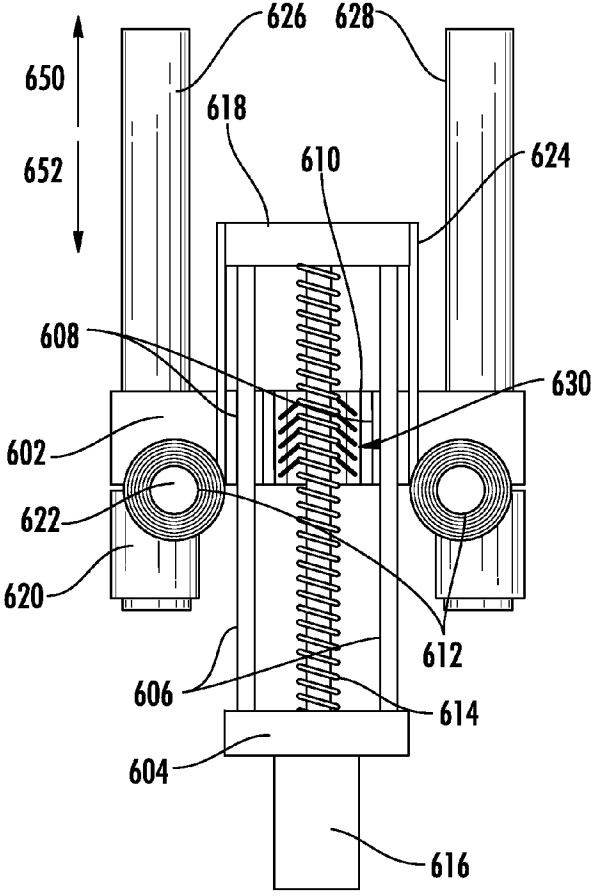

As shown in FIG. 5, one or more sensors 506, 508 may be provided for detecting a location of the moving carrier 118 along the length of a rod 510. These sensors can facilitate the accurate placement of the RPDs 112, 114 relative to a suspicious item. The sensors 506, 508 can include, but are not limited to, switches or other sensors for detecting object without coming into contact with them. Any known or to be known sensor suitable for a particular application can be used herein without limitation.

Referring now to FIGS. 6-8, there are shown schematic illustrations that are useful for understanding linear movement of a moving carrier (e.g., moving carrier 118 of FIGS. 1-5) relative to a robotic arm (not shown in FIGS. 6-8) and operations of a RAM (e.g., RAM 120 of FIGS. 1-5). Moving carrier 602 of FIGS. 6-8 can be the same as or similar to moving carrier 118 described above. As such, the discussion of moving carrier 602 is sufficient for understanding moving carrier 118 of FIGS. 1-5. Similarly, the RAM 620 of FIGS. 6-8 is similar to the RAM 120 described above. As such, the discussion of RAM 620 is sufficient for understanding RAM 120 of FIGS. 1-5. The RAM 620 comprises springs 612 rolled on reels 622. The reels 622 are coupled to the moving carrier 602. An end 624 of each spring 612 is coupled to a stationary frame member 618.

For purposes of understanding the following discussion, the direction that the RPDs 626, 628 point or aim is shown by arrow 650. So if one or more of the RPDs 626, 628 is fired, an impulse force is applied thereby against the moving carrier 602 in an impulse direction 652 (i.e., a direction opposite to that shown by arrow 650). When such an impulse force is applied to the moving carrier 602, it slides in the impulse direction 652 along rails 606. The sliding movement of the moving carrier 602 is facilitated by bearings 608. The rails 606 and bearings 608 are formed of materials that have a relatively low coefficient of friction.

In the middle of the moving carrier 602, a Unidirectional Force Transfer ("UFT") mechanism 610 is provided. The UFT mechanism 610 comprises an aperture formed in the moving carrier 602 and a plurality of flexible fins 630 disposed along a sidewall of the aperture. The fins 630 engage threads of a rod 614 such that the moving carrier 602 is freely movable in the impulse direction 652 and prevented from moving in the firing direction 650 when a pushing force is applied thereto in said firing direction 650.

Notably, the springs 612 are under tension at all times. In some scenarios, there is a 150 pound constant force pull from the springs 612. So when the RPDs 626, 628 are in their deployed positions shown in FIG. 7, the springs 612 are pulling the moving carrier 602 towards the frame member 618. In effect, the fins 630 latch the moving carrier 602 in place so that movement of the carrier does not interfere with accurate aiming of the RPDs 626, 628 prior to and during firing thereof.

As a consequence of firing the RPDs 626, 628, a force of the impulse is well above the combined pulling force of the springs 612. In some cases, the impulse force is a few thousand pounds of pull force in direction 652, while the spring force is a few hundred pounds in direction 650. Therefore, the impulse force causes (1) a passive breakaway of the fins 630 and (2) the moving carrier 602 to slide along rails 606 is the impulse direction 652 until the RPDs 626, 628 reach their retracted positions shown in FIG. 8. When the RPDs 626, 628 reach their retracted positions, the impulse force is no longer being applied to the assembly. At this time, the moving carrier 602 is latched into position by the fins 630 and the pulling force of the springs 612.

As the moving carrier 602 is sliding in the impulse direction 652, the energy from the RPD firing is being absorbed by the springs 612. Energy stored is defined mathematically as force times distance. As such, the stroke distance 700 is selected to ensure that all the energy from the RPD firing is stored in the springs 612. In some scenarios, the stroke distance 700 is selected to be about 10 inches.

The force that is transferred to the robotic arm (e.g., robotic arm 102 of FIG. 1) via the frame member 618 is the constant pulling force of the springs 612. Thus, the relatively high impulse force of a few milliseconds is spread over a longer period of time as the moving carrier 602 slidingly travels in the impulse direction 652. The robotic arm does see force transmitted through to it, but such force is only a relatively small fraction of the impulse force (e.g., 1/10 of the impulse force that the RPD firing is producing on the moving carrier 602).

The RPDs 626, 628 may be maintained in their retracted position until another firing thereof is desirable. In the retracted position, the RPDs 626, 628 do not interfere with operations of a robotic arm (e.g., robotic arm 102 of FIG. 1) to which the frame 604, 618 is attached. When a user desires to fire the RPDs 626, 628 again, the RPDs 626, 628 can be transitioned from their retracted position shown in FIG. 8 to their deployed position shown in FIG. 7. Such a position transition is achieved by using a motor 616 with a gear head (not visible in FIGS. 6-8). As the motor 616 spins the gear head, the threaded rod 614 is turned in a direction for causing movement of moving carrier 602 in the firing directing 650. A reverse spin of the motor 616 will crank the moving carrier 602 back to the position shown in FIG. 8.

The present invention is not limited to the exemplary architecture shown in FIGS. 6-8. For example, the threaded rod 614 may be replaced with another mechanical mechanism, such as a linear element with notches for latchingly engaging the fins 630. In this case, the motor may be configured to pull and push the linear notched element, as opposed to spin the same as is described above in relation to the threaded rod.

Figure 9:
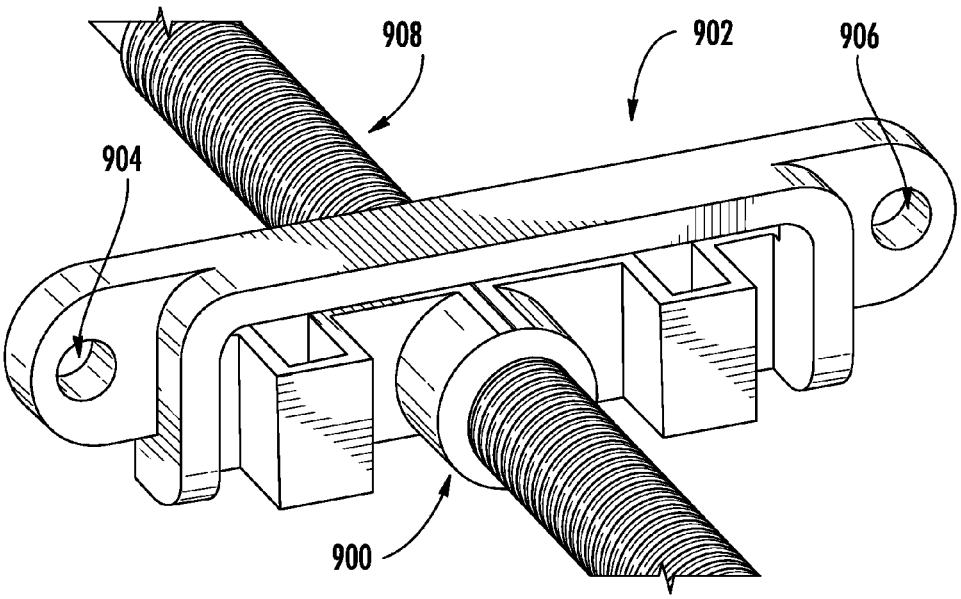
FIGS. 9-10 provide schematic illustrations that are useful for understanding an exemplary architecture of a unidirectional force transfer mechanism.
Figure 10:
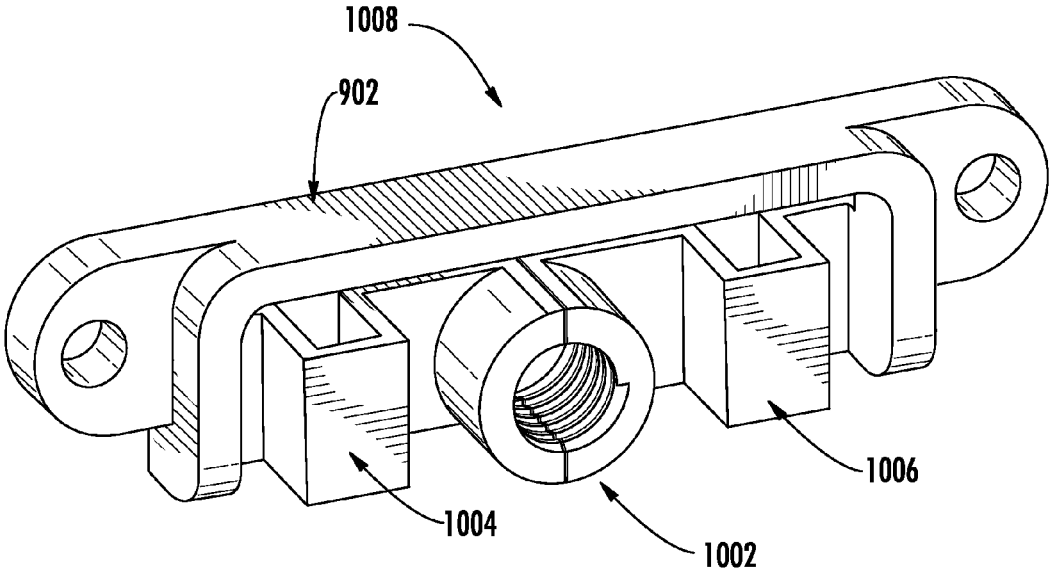

Referring now to FIGS. 9-10, there are provided schematic illustrations that are useful for understanding an exemplary architecture of a UFT mechanism 900. UFT mechanism 512 of FIGS. 5 and 610 of FIG. 6 are the same as or similar to UFT mechanism 900. As such, the discussion of UFT mechanism 900 is sufficient for understanding UFT mechanisms 610.

As shown in FIGS. 9-10, the UFT mechanism 900 comprises a nut 1002 which can be thread onto a threaded rod 908 (e.g., threaded rod 614 of FIG. 6). The nut 1002 has been split in half and attached to a rigid support structure 902 via mechanical spring elements 1004-1006. The rigid support structure 902 comprises two apertures 904, 906 through which couplers (e.g., screws) can be inserted for attaching the rigid support structure 902 to a moving carrier. When the rigid support structure 902 is mechanically coupled to the moving carrier, a surface 1008 of the rigid support structure 902 abuts a surface of the moving carrier. In effect, when the threaded rod 908 is pushed in a direction towards the moving carrier, the nut 1002 will not split apart. However, when the threaded rod 908 is pulled in an opposite direction, the nut 1002 splits apart. The nut 1002 re-engages with the threaded rod 908 upon termination of the pulling force.

Figure 11:
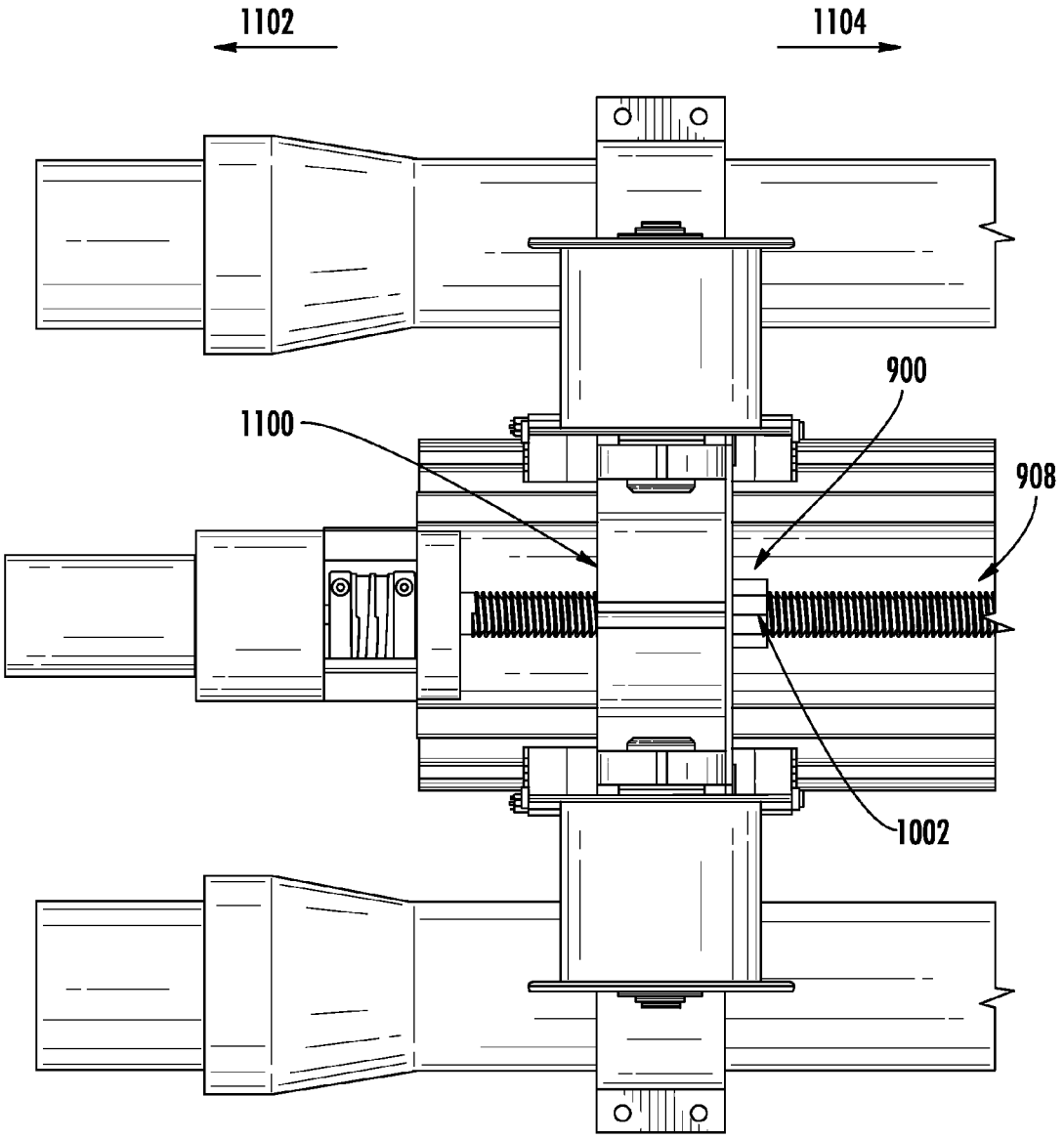
FIG. 11 provides a schematic illustration of the UFT mechanism shown in FIGS. 9-10 mechanically coupled to a moving carrier.

A schematic illustration showing the UFT mechanism 900 mechanically coupled to a moving carrier 1100 is provided in FIG. 11. In response to an RPD firing, the moving carrier 1100 will slide in direction 1102, whereby the nut 1002 splits apart. When the moving carrier 1100 stops traveling in direction 1102, the mechanical spring elements 1004-1006 (not visible in FIG. 11) push the two split nut portions towards each other. As the constant force springs pull the moving carrier in direction 1104, the threads of nut 1002 engage the threads of threaded rod 908. In effect, further movement of the moving carrier 1100 in direction 1104 is prevented. A motor can then be used to facilitate movement of the moving carrier 1100 in direction 1104, as described above.

In view of the forgoing, the present invention provides a mechanism for absorbing an impulsive load. The mechanism comprises: a fixed frame with a movable carrier (e.g., carrier 602 of FIG. 6) mounted to the frame via sliding elements (e.g., linear guide rods 606 of FIG. 6); springs (e.g., springs 612 of FIG. 6) attached at one end to the fixed frame (e.g., frame 618 of FIG. 6) and at the other end to a movable carrier; and a UFT element (e.g., UFT mechanism 610 of FIG. 6 or 900 of FIGS. 9-10) mounted to the moving carrier and interfacing with a latching element (e.g., threaded rod 614 of FIG. 6). The springs can include, but are not limited to, constant force springs. The latching element may be attached to a motor (e.g., motor 616 of FIG. 6) in such a way that the action of the motor moves the latching element, whereby the UFT element is displaced along the length of the latching element. The UFT element may comprise, but is not limited to, a split nut (e.g., nut 1002 of FIG. 10) attached to mechanical spring elements (e.g., mechanical springs 1004-1006 of FIG. 10). In all cases, the UFT element includes a set of angled flexible fins (e.g., fins 630 of FIG. 6).

The robotic assembly of the present invention overcomes various drawbacks of conventional robotic assemblies, such as that disclosed in the background section of this document. For example, the length ratio between the stroke length of the recoil absorbing mechanism and the total length of the recoil absorbing mechanism is significantly improved in the present invention as compared to that of the conventional robotic assemblies. As such, the recoil absorbing mechanism of the present invention is much more compact as compared to conventional recoil absorbing mechanisms. Also, a constant recoil force is ensured in the present invention by the constant force springs. This is not the case in conventional designs. Furthermore, conventional designs do not enable active retraction/deployment of the RPDs, and/or use of varying size/energy RPDs in a single compact design.

Figure 12:
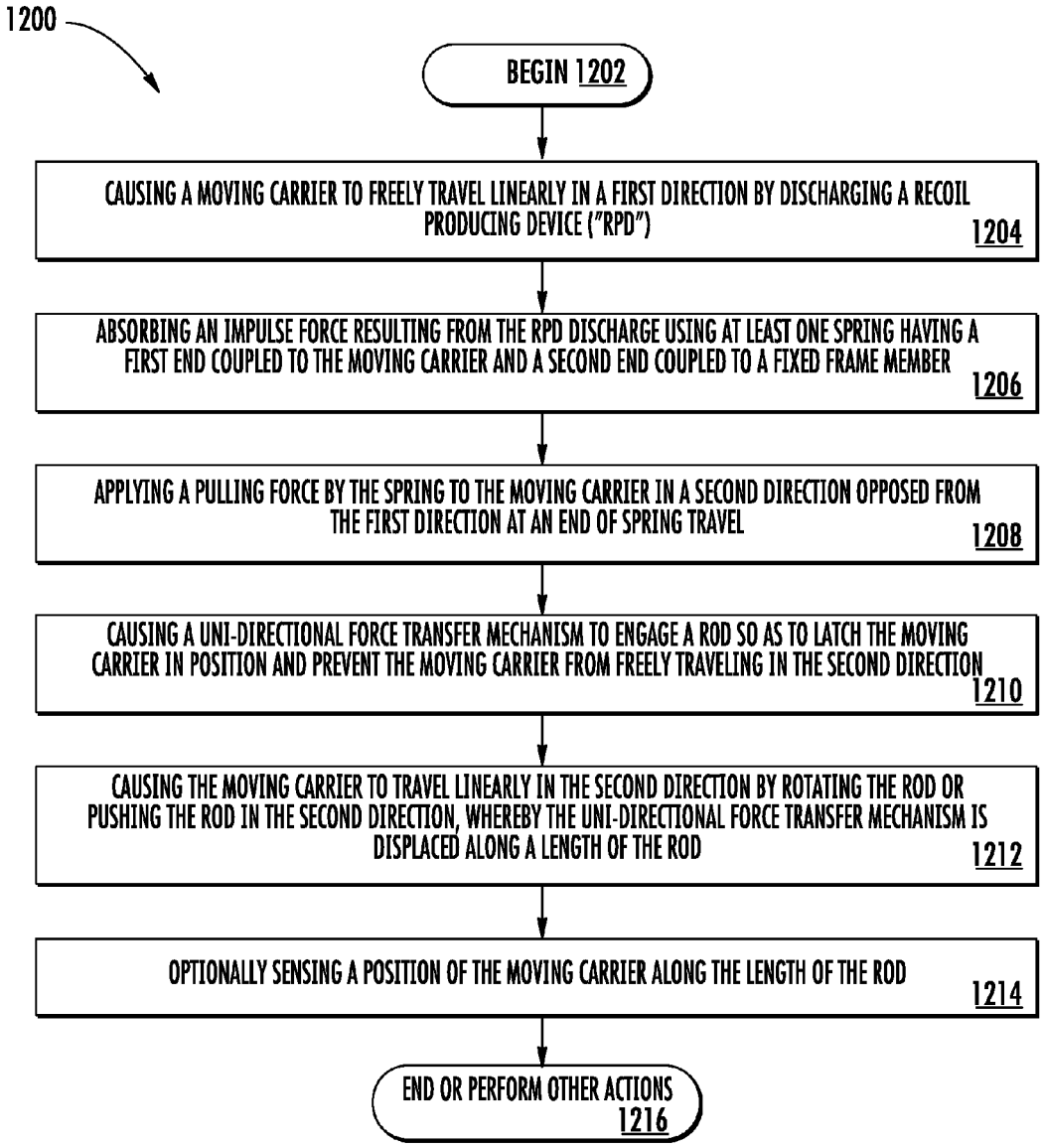
FIG. 12 is a flow diagram of an exemplary method for recoil absorption.

Referring now to FIG. 12, there is provided a flow diagram of an exemplary method 1200 for recoil absorption. The method 1200 begins with step 1202 and continues with step 1204. In step 1204, a moving carrier (e.g., moving carrier 118 of FIG. 1, 602 of FIG. 6 or 1100 of FIG. 11) is caused to freely travel in a first direction (e.g., direction 504 of FIG. 5, 652 of FIG. 6 or 1102 if FIG. 11) by discharging an RPD (e.g., RPD 110, 112, 114 of FIG. 1 or 626, 628 of FIG. 6). Next in step 1206, an impulse force resulting from the RPD discharge is absorbed using at least one spring (e.g., spring 122, 124 of FIG. 1 or 612 of FIG. 6). The spring can include, but is not limited to, a constant force spring or a coil spring. In both cases, the spring has a first end coupled to the moving carrier and a second end (e.g., end 130 of FIG. 1) to a fixed frame member (e.g., frame member 132 of FIG. 1 or 618 of FIG. 6). The spring applies a pulling force on the moving carrier in a second direction opposed from the first direction at the end of spring travel, as shown by step 1208. In turn, a uni-directional force transfer mechanism (e.g., UFT 512 of FIG. 5, UFT 610 of FIG. 6 or 900 of FIG. 9) is caused to engage a rod (e.g., rod 510 of FIG. 5, rod 614 of FIG. 6 or 908 of FIG. 9) so as to latch the moving carrier in position and prevent the moving carrier from freely traveling in the second direction. Thereafter, step 1212 is performed where the moving carrier is caused to travel linearly in the second direction by rotating the rod or pushing the rod in the second direction. As a result of such rotating or pushing, the uni-directional force transfer mechanism is displaced along a length of the rod. Next in optional step 1214, the position of the moving carrier is sensed along the length of the rod. Subsequently, step 1216 is performed where method 1200 ends or other actions are performed.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

We claim:

1. A method for recoil assembly, comprising:

causing a moving carrier to freely travel linearly in a first direction by discharging at least one Recoil Producing Device ("RPD");

absorbing an impulse force resulting from discharging said RPD using at least one spring having a first end coupled to said moving carrier and a second end coupled to a fixed frame member; and applying a pulling force by said spring to said moving carrier in a second direction opposed from said first direction at an end of spring travel, whereby a uni-directional force transfer mechanism is caused to engage an elongate latching element so as to latch said moving carrier in position and prevent said moving carrier from freely traveling in said second direction.

2. The method according to claim 1, wherein said spring comprises a constant force spring.

3. The method according to claim 1, further comprising transmitting a constant force to a robot from said spring when said impulse force is being absorbed by said spring.

4. The method according to claim 1, wherein said latching element comprises a threaded rod.

5. The method according to claim 1, further comprising causing said moving carrier to travel linearly in said second direction by rotating said elongate latching element or pushing said elongate latching element in said second direction.

6. The method according to claim 1, further comprising causing said moving carrier to travel linearly in said second direction by displacing said uni-directional force transfer mechanism along a length of said latching element.

7. The method according to claim 1, wherein said uni-directional force transfer mechanism comprises a split nut attached to a rigid support structure via mechanical spring elements.

8. The method according to claim 1, wherein said uni-directional force transfer mechanism comprises a plurality of flexible fins engaging threads or notches formed along a length of said elongate latching element.

9. The method according to claim 1, wherein said moving carrier is mechanically coupled to said RPD.

10. The method according to claim 1, further comprising sensing a position of said moving carrier along a length of said elongate latching element.

11. A recoil absorption assembly, comprising:

a fixed frame member;

an elongate latching element coupled to said fixed frame member;

a moving carrier coupled to said elongate latching element so as to be able to freely linearly slide along a length of said elongate latching element in a first direction when at least one Recoil Producing Device ("RPD") is discharged;

at least one spring having a first end coupled to said moving carrier and a second end coupled to said fixed frame member, said spring absorbing an impulse force resulting from discharging said RPD; and a uni-directional force transfer mechanism engaging said elongate latching element when a pulling force is applied by said spring to said moving carrier in a second direction opposed from said first direction at an end of spring travel, whereby said moving carrier in latched into position and prevented from freely traveling in said second direction.

12. The recoil absorption assembly according to claim 11, wherein said spring comprises a constant force spring.

13. The recoil absorption assembly according to claim 11, wherein a constant force is transmitted to a robot from said spring when said impulse force is being absorbed by said spring.

14. The recoil absorption assembly according to claim 11, wherein said latching element comprises a threaded rod.

15. The recoil absorption assembly according to claim 11, wherein said moving carrier is caused to travel linearly in said second direction by rotating said elongate latching element or pushing said elongate latching element in said second direction.

16. The recoil absorption assembly according to claim 11, wherein said moving carrier is caused to travel linearly in said second direction by displacing said uni-directional force transfer mechanism along a length of said latching element.

17. The recoil absorption assembly according to claim 11, wherein said uni-directional force transfer mechanism comprises a split nut attached to a rigid support structure via mechanical spring elements.

18. The recoil absorption assembly according to claim 11, wherein said uni-directional force transfer mechanism comprises a plurality of flexible fins engaging threads or notches formed along a length of said elongate latching element.

19. The recoil absorption assembly according to claim 11, wherein said moving carrier is mechanically coupled to said RPD.

20. The recoil absorption assembly according to claim 11, further comprising at least one sensor sensing a position of said moving carrier along a length of said elongate latching element.

* * * * *